United States Patent [19]

Ketterer

[11] 4,112,808

[45] Sep. 12, 1978

[54] DEVICE FOR CLEANING AND REVITALIZING WOUND STRINGS FOR MUSICAL INSTRUMENTS

[76] Inventor: Richard J. Ketterer, 35 Glenbrook Dr., Pittsburgh, Pa. 15235

[21] Appl. No.: 805,184

[22] Filed: Jun. 9, 1977

[51] Int. Cl.[2] ..... G10G 7/00; G10C 9/00

[52] U.S. Cl. ..... 84/453

[58] Field of Search ..... 84/453, 199 X, 297 S X, 84/455 X, 458 X; 29/81 R, 81 F, 81 L X, 81; 15/256.6

[56] References Cited

U.S. PATENT DOCUMENTS

| | | | |
|---|---|---|---|
| 2,702,937 | 3/1955 | Smart | 29/81 F |
| 2,746,513 | 5/1956 | Kiesow | 29/81 F |

*Primary Examiner*—L. T. Hix
*Assistant Examiner*—S. D. Schneyer
*Attorney, Agent, or Firm*—Buell, Blenko & Ziesenheim

[57] ABSTRACT

A hand-held device for cleaning and revitalizing wound strings of musical instruments, such as a bass guitar or piano. The device comprises a rectangular metal plate of aluminum or other similar light-weight metal and two similar cylindrical rollers of hardened and polished metal rotatably mounted on axes perpendicular to one side thereof in spaced relation to each other. The rollers have aligned annular grooves thereon normal to the axes of rotation thereof. The device is used by fitting the device to the string so that the string passes around one roller within the groove then between the rollers and around the other roller within the groove. Then while maintaining the string tensioned, the device is slightly twisted longitudinally while moving slowly back and forth along the string to spread the turns of the wound wire on the core of the string. This movement is repeated a number of times while turning the device in opposite directions relative to the axis of the string to cover the entire circumference of the string. The spreading of the wound turns on the string dislodges dirt and dust and cleans the string.

4 Claims, 5 Drawing Figures

DEVICE FOR CLEANING AND REVITALIZING WOUND STRINGS FOR MUSICAL INSTRUMENTS

This invention relates to devices for cleaning and revitalizing wound strings for musical instruments, such as bass guitars and pianos.

It is well known to musicians, particularly those who play a bass guitar or a piano, that the wound strings of the instrument go "dead" or lose their tonal quality with use and for this reason require replacement. The reason the strings lose their tonal quality is that the turns of the helically wound fine gauge wire on the single strand heavier wire core collect dust and dirt particles and often become rusted from perspiration of the musician playing the instrument.

Replacement of "dead" strings is costly as are the fees charged by professional people who have commercial devices for cleaning the strings.

It is an object of my invention to provide a simple hand-held device which will enable a musician or other person to readily and easily clean and revitalize the strings of a musical instrument, such as a bass guitar.

I am aware of a device used by professionals for cleaning wound strings of musical instruments. However, the device is relatively complex and costly and cannot be used by the average musician unless specially trained or skilled.

To attain the object of my invention, I provide a simple small hand-held device for cleaning wound strings of musical instruments, which device is of relatively low cost and simplicity, compared to known devices, and which may be used readily by persons not specially trained or skilled for the purpose.

More particularly, I provide a device of the type described in the preceding paragraph, which comprises only a few parts, consisting essentially of a small rectangular plate, of light-weight metal, and two similar cylindrical rollers mounted in spaced relation on bolts attached perpendicularly to one side of the plate for rotation on respective axes perpendicular to the plane of the metal plate. The rollers have aligned annular grooves for engagement by the strings as hereafter described more fully.

Figure 1:
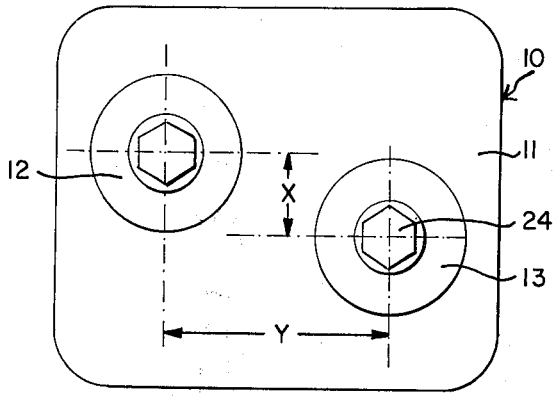
Figure 3:
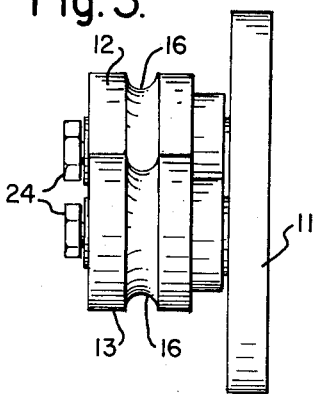
Figure 2:
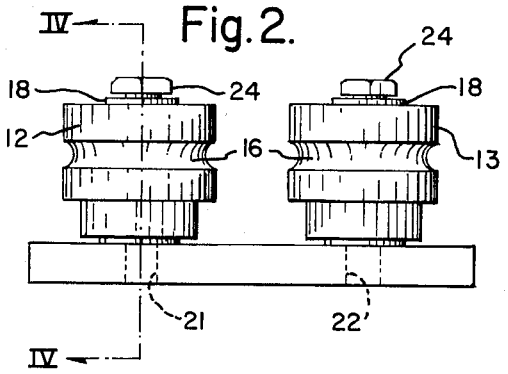
Figure 4:
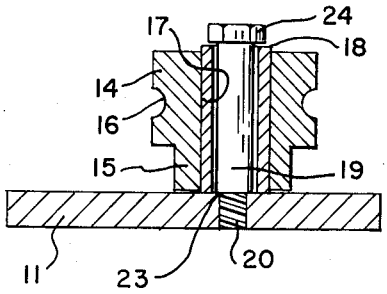
Figure 5:
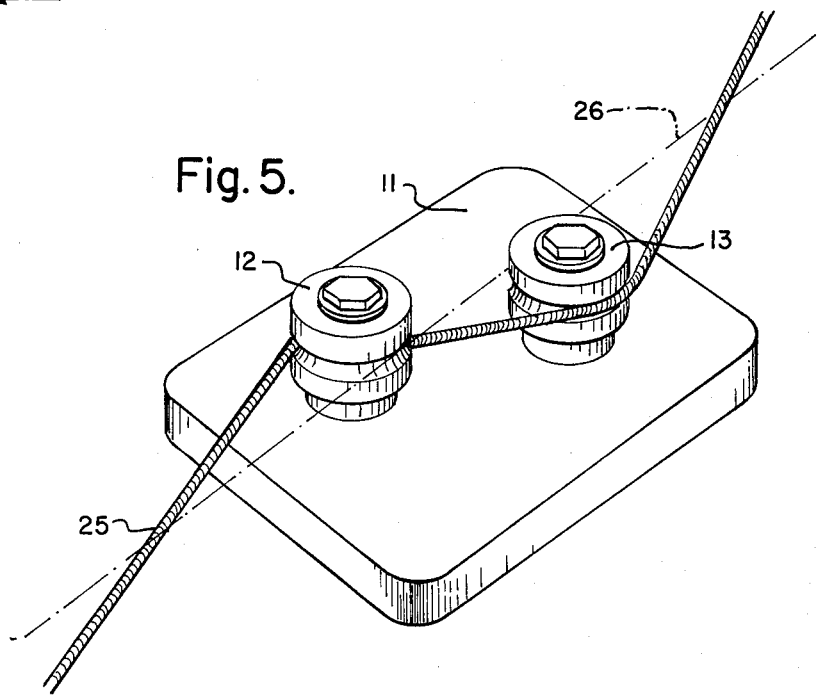

A preferred embodiment of my invention and the manner of its use will be described hereinafter in detail in connection with the accompanying drawings, wherein:

FIG. 1 is a plan view of the preferred embodiment of my invention, shown at substantially full scale dimensions, FIG. 2 is a side elevational view of the embodiment shown in FIG. 1, FIG. 3 is an end view of the embodiment of FIG. 1, as viewed from the right end thereof, FIG. 4 is a sectional view, taken on the line IV–IV of FIG. 2, and FIG. 5 is a perspective view of the device shown in FIG. 1, illustrating the manner of its use.

Referring to the Figures of the drawings, the embodiment of the device 10 shown comprises a base plate 11 of light-weight metal such as aluminum, and two cylindrical rollers 12 and 13. As illustrated, the rollers 12 and 13 are identical in material and dimensions, though some variation in the dimensions of the two rollers is permissible. The rollers 12 and 13 are preferably machined from hardened steel and finished to accurate dimensions as hereinafter explained. As seen in FIG. 4, each roller 12 and 13 comprises a cylindrical body, one portion 14 of which is of relatively larger diameter than the other portion 15. Substantially midway of the opposite ends of the larger diameter portion 14 is an annular groove 16, the width of which is somewhat larger than the depth, and the bottom of which is of substantially semi-circular contour.

Each roller 12 and 13 is further provided with a central bore 17 in which is snugly received a bushing 18. I prefer that the bushing 18 be slightly longer than the roller for a reason hereinafter explained.

Each of the rollers 12 and 13 is attached to the plate 11 by a bolt 19, of the so-called "unbrako" type, the threads 20 of which engage the corresponding threads of a tapped bore 21, 22 in the plate 11 for the respective rollers 12 and 13. The threads 20 of each bolt 19 are of lesser diameter than that of the body of the bolt to provide a shoulder 23 therebetween. The diameter of the body of the bolt 19 is sufficiently less than the inner diameter of the bushing 18 to provide for free rotation of the roller on the body of the bolt. Moreover, the length of the body of the bolt 19 between the inside of the head 24 and the shoulder 23 is slightly longer than the length of bushings 18. Consequently, when the bolt is screwed into the tapped bores 21, 22 in plate 11, the shoulder 23 on the bolt seats on the face of the metal plate 11 and thus insures clearance for the bushing and roller to prevent binding or other restriction to free rotation of the rollers on the bolts 19. The bushing 18 is preferably slightly longer than the roller to insure that the roller does not rub on the plate due to laterally exerted forces thereon while in use.

The spacing of the tapped bores 21 and 22 is an important consideration in the function of the device. I prefer to provide a lateral spacing, designated X, (FIG. 1) between the center lines of the tapped bores 21 and 22 and a longitudinal spacing therebetween, designated Y, having ranges of dimensions as specified in the table following. Approximately, it may be said that the lateral spacing of the bores 21 and 22 is $\frac{1}{3}$ that of the longitudinal spacing. By maintaining approximately the spacing between the rollers 12 and 13 thus provided, the curvatures or bendings of the wound turns of the strings is such as to insure separation or opening thereof when the device 10 is in use as hereafter described.

Also, while some variation of the dimensions of other parts of the device is permissible, I prefer to keep within the ranges of dimensions for the parts of the device, as specified in the following table:

| Part | Range |
|---|---|
| Plate II - thickness | .250 (nominal) |
| width | 2.515 - 2.485 inches |
| length | 3.015 - 2.985 inches |
| Location of Bores 21 and 22 | |
| Space from end of plate | .765 - .735 inch |
| Space from side of plate | 1.015 - .985 inch |
| Spacing X | .515 - .485 inch |
| Spacing Y | 1.515 - 1.485 inch |
| Rollers 12 and 13 | |
| Larger Diameter | 1.015 - .985 inch |
| Smaller Diameter | .765 - .735 inch |
| Total Length | .895 - .860 inch |
| Length of Small Diameter | .260 - .240 inch |
| Bore 17 (diameter) | .478 - .458 inch |
| Bushing 18 (O.D.) | .447 - .427 inch |
| Bushing 18 (I.D.) | .288 - .280 inch |
| Length | 1.015 - .985 inch |
| Groove in Rollers 12 and 13 | |
| Width | .192 - .182 inch |
| Depth | .130 - .120 inch |

-continued

| Part | Range |
|---|---|
| Distance from Small Diameter end | .567 – .547 inch |

For an explanation as to the manner in which the device is used, refer now to FIG. 5.

It should be understood that one end of the wound string 25 is allowed to remain attached to the instrument, while the other end is disconnected or loosened from the instrument. While exerting a pulling force on the disconnected end of the string 25 to keep it taut, the user threads the string 25, into the grooves 16 of the rollers 12 and 13 in the manner shown in FIG. 5. It should be understood that, if desired, one person may hold the instrument while the other holds the free end of the string and operates the device. As shown, a portion of the string 25 passes around roller 12, then between rollers 12 and 13, and finally around the roller 13 back to the instrument. While keeping the string 25 stretched out taut, the user turns the device 10 in the plane of metal plate 11 to stretch the string 25 alternately to one side and to the other side of a line 26 representing the original position of the string. Then the user slowly moves the device back and forth repeatedly along the string. It will be seen that the turns of fine wire wound on the core of the string 25 are separated or opened in passing around the rollers 12 and 13, allowing the dust and dirt attached to or clogging the turns to fall out and thus be removed. After several back and forth moves of the device 10 it is then rotated with respect to line 26, first in one direction and then in the other, thereby insuring that the entire circumferential surface of the string is contacted by the rollers 12 and 13 in the movement of the device 10 back and forth along the length of the string for each position of the device 10.

Upon completion of the operation of cleaning the string 25, the string should be reconnected and tensioned to proper pitch on the instrument.

The importance of maintaining a clearance between the roller and the plate will be apparent from the fact that the effort required to move the device 10 back and forth along the taut string, while twisting the device to further stretch the string, necessitates the rollers being freely rotatable with minimum friction. The construction which I have devised for mounting the rollers 12 and 13 is thus a salient factor in ease of operation of the device. Suitable lubrication, such as a graphite light machine oil, may be used to ease the friction of rotation of the rollers on the bolt 19.

If any buzzes occur from the string, after being tensioned to pitch, the string should be removed and then twisted, in the direction of the turns of fine wire on the string, at least one full turn. This turning will insure that any loose turns on the string will be pressed tighter together and to the core wire of the string.

After this last operation, the string should be reinstalled on the instrument and re-adjusted to appropriate pitch.

It will be seen that by means of my device, a musician or any other relatively unskilled person is enabled to clean and revitalize the wound strings of musical instruments. In consequence, the musician is able to lengthen the period of use of strings for his musical instruments, thereby saving both in the cost of new strings and in the fees for cleaning charged by professional people. Moreover, my device may be made to sell at such nominal cost, that most musicians will be able and willing to purchase my device.

In the foregoing specification I have described presently preferred embodiments of my invention; however, it will be understood that my invention can be otherwise embodied within the scope of the following claims.

I claim:

1. A device for cleaning and revitalizing the wound strings of musical instruments comprising a polygonal base plate of light-weight material, and capable of being conveniently held in one hand, two similar cylindrical rollers mounted for rotation on respective axes perpendicular to the plane of said base plate, said rollers being of hardened metal and having respective aligned annular grooves therein normal to the axes of rotation, the bottom of said grooves being substantially semi-circular in contour, the axes of said rollers being spaced laterally and longitudinally in a ratio of approximately 1 to 3 to insure distension of the wound turns in the musical strings as the device is shifted longitudinally along a musical string engaging an arc on the side of one roller and an arc on the diametrically opposite side of the other roller.

2. A device for cleaning and revitalizing the wound strings of musical instruments according to claim 1, wherein each of the said rollers comprises two coaxially related portions of respectively different diameters, the said annular grooves being located midway of the length of the portion of larger diameter.

3. A device for cleaning and revitalizing the wound strings of musical instruments according to claim 1, wherein the respective axes of rotation of the rollers are separated laterally by a distance X and longitudinally by a distance Y, the distance X being in the range of 0.515 to 0.485 inches and the distance Y being in the range of 1.515 to 1.485 inches.

4. A device for cleaning and revitalizing the wound strings of musical instruments according to claim 1, wherein each of said rollers has a central bore, a bushing snugly fitted in said bore, and a bolt of the "unbrako" type extending through said bushing and engaging in tapped bores in said base plate, said bolt having a shoulder thereon between the end threads and the body of the bolt, which shoulder seats on the base plate to insure clearance between the roller and the plate as said roller rotates on said bolt.

* * * * *